United States Patent [19]

Kobayashi et al.

[11] Patent Number: 4,576,275

[45] Date of Patent: Mar. 18, 1986

[54] COIN DISCRIMINATION APPARATUS

[75] Inventors: Osamu Kobayashi; Masanori Tanaka; Jun Ishii, all of Saitama, Japan

[73] Assignee: Kabushiki Kaisha Nipponcoinco, Tokyo, Japan

[21] Appl. No.: 643,845

[22] Filed: Aug. 23, 1984

[30] Foreign Application Priority Data

Aug. 25, 1983 [JP] Japan ..... 58-130362[U]
Aug. 30, 1983 [JP] Japan ..... 58-133048[U]
Aug. 30, 1983 [JP] Japan ..... 58-133049[U]

[51] Int. Cl.[4] ..... G07F 3/02

[52] U.S. Cl. ..... 194/203; 194/317; 194/336

[58] Field of Search ..... 194/97 R, 97 B, 99, 194/102, 100 A, 100 R; 133/3 R

[56] References Cited

U.S. PATENT DOCUMENTS 3,169,625 8/1962 Peterson ..... 194/99 X
4,128,157 12/1978 Henville ..... 194/97 R
4,374,557 2/1983 Sugimoto et al. ..... 133/3 R X

*Primary Examiner*—Stanley H. Tollberg
*Attorney, Agent, or Firm*—Koda and Androlia

[57] ABSTRACT

A coin discrimination member and a coin selection member are mounted on one of two plates defining a coin path. Counterfeit coins are removed from the coin path between the two plates at an upstream portion thereof in response to a discrimination signal from an electronic discrimination unit. Thereafter, the authentic coins are discriminated and sorted by the coin discrimination member and the coin selection member. One plate is detachably pivoted about the other plate.

7 Claims, 10 Drawing Figures

COIN DISCRIMINATION APPARATUS

BACKGROUND OF THE INVENTION

1. Field of the Invention

The present invention relates to a coin discrimination apparatus used in a vending machine or a coin exchange machine.

2. Prior Art

In a coin discrimination apparatus, a discriminating mechanism such as an electronic discrimination unit or cradle is provided in a coin path formed between two plates, and a coin path selector is provided to discriminate and store coins.

A conventional coin discrimination apparatus discriminates the authenticity/counterfeitness of coins and their denominations in accordance with their diameters, thickness, weights or the like. For this reason, the discrimination precision must be high so that erroneous discrimination can be prevented.

In a conventional coin discrimination apparatus having an electronic discrimination unit, solenoids for the respective denominations are actuated in response to discrimination signals from an electronic discrimination unit so as to discriminate coins in units of their denominations. The coins of each denomination are guided to the corresponding coin path. For this reason, a plurality of solenoids must be provided in accordance with the number of denominations of coins which are inserted in the coin discrimination apparatus. Therefore, the coin discrimination apparatus has higher cost than that having a single discrimination member.

Furthermore, in the conventional coin discrimination apparatus, a discrimination member such as a cradle is mounted at the side of one plate, and a solenoid for driving a selector member is mounted at the side of the other plate. Particularly, in a conventional coin discrimination apparatus having as a return path a space (at the side of one plate) other than the space defined between these two plates, for example, when a coin is guided into a space other than that between the two plates, a solenoid is disposed on the other plate which does not define the return path. A selection member is actuated by the solenoid to cross the coin into the return path. In this manner, the coin return path can be assured without being interfered by the solenoid and the like.

On the other hand, a circuit board having an electronic circuit for controlling the coin discrimination apparatus is mounted on one plate. As described above, the discrimination member, the selection member and the solenoid are arranged at two sides of the coin path, so that the circuit board must have a specific shape so as not to interfere with the solenoid mounted on the plate. The circuit board is divided into pieces which are then mounted on the plate, thus resulting in a time-consuming and cumbersome operation. In addition to this disadvantage, extra repair is required in addition to replacement of the circuit board at the time of repair and maintenance. In addition, the plates for forming the coin path are easily contaminated by dust and oil attached to the coins.

In addition, the two plates of the coin discrimination apparatus are also contaminated by dust or powders with steam in accordance with the type of item sold by a vending machine. Dust laden stream or the like cause rusting of component parts of the coin discrimination apparatus, and coins may not then be properly guided or discriminated. In this case, dust or the like must be removed from the surfaces of the plates and the components on the plates. For this purpose, a coin discrimination apparatus with a detachably mounted device plate as one plate serving as a coin discrimination member is proposed in Japanese Utility Model Publication No. 55-37986. According to this conventional coin discrimination apparatus, one side of the device plate having the coin discriminating member is mounted on an upper portion of a main plate as the other plate to be freely opened through a shaft. At the same time, a spring is wound around the shaft to urge the device plate toward the main plate. The intermediate portion of the spring is bent and extends toward the inner surface of the device plate. An end portion of the spring is bent and engaged with an end of an engaging window formed in the main plate. In this manner, the device plate is mounted on the main plate.

However, according to the conventional coin discrimination apparatus described above, the construction becomes complicated, and assembly operation becomes time-consuming. In addition to these disadvantages, it is cumbersome to attach the device plate or detach it from the main plate. The device plate is urged against the main plate by only the spring, so that the biasing force of the spring must be large. As a result, a strong force by the spring acts on the shaft, so that a very rigid material must be used for the shaft, resulting in a higher cost.

SUMMARY OF THE INVENTION

It is a first object of the present invention to overcome the conventional drawbacks and to provide a coin discrimination apparatus wherein the number of solenoids is decreased by the combination of a discrimination unit and a discrimination member, and high precision of the discrimination member is not required.

It is a second object of the present invention to provide a coin discrimination apparatus having a large space behind one of the two plates defining a coin path so as to allow easy arrangement of a control circuit in this large space.

It is a third object of the present invention to provide a coin discrimination apparatus wherein the two plates defining the coin path are arranged such that one plate is detachably mounted on the other plate, and wherein a simple plate detaching mechanism is provided.

It is a fourth object of the present invention to provide a compact coin discrimination apparatus having a counterfeit coin return path in a space other than the space defined by the two plates.

It is a fifth object of the present invention to provide a coin discrimination apparatus for detecting illegal behavior such as a coin with a string being inserted into a vending machine or the like and this being then pulled up through a coin insertion port after a desired item is delivered.

In order to achieve the above objects of the present invention, there is provided a coin discrimination apparatus wherein an electronic discrimination unit is arranged at the upstream side of a coin path defined by two plates, a first coin selection member is arranged at a downstream side of the electronic discrimination unit to eliminate a counterfeit coin from the space between the two plates in response to a signal from the electronic discrimination unit, at least one second coin selection member is arranged at a downstream side of the first coin selection member to sort authentic coins into a plurality of groups in response to the signal from the electronic discrimination unit, a coin discrimination member is arranged at a downstream side of at least one second coin selection member to discriminate the authentic coins sorted by the second coin selection member in units of their denominations, the first and second coin selection members, a drive member for driving the coin selection members and the discrimination member are arranged on one plate, a shaft provided with the one plate is pivotally supported by a support and a shaft holder which are mounted on the other plate, the support being provided with a support groove, so that one plate is detachably mounted on the other plate and can be freely opened with respect thereto. In addition, a blade is arranged in a more upstream side of the coin path to cut a string, and a coin regulator is arranged to move the coins to the side of one plate.

According to the coin discrimination apparatus having the construction described, counterfeit coins are removed, and only authentic coins are guided to the coin discrimination member. Therefore, even if a mechanical discrimination member is used to discriminate coins in accordance with their outer dimensions such as diameter and weight, precise discrimination can be performed. Since the counterfeit coins have been removed, the coins having similar diameters and weights will not be guided to the selection members. The characteristics such as diameter and weight of coins guided by the discrimination member are clearly discriminated in response to signals from the electronic discrimination unit, thereby easily and accurately discriminating the coins. In this sense, a highly precise discrimination member need not be used, and the coin discrimination apparatus as a whole has a low cost.

Furthermore, the number of solenoids for selecting coins can be decreased as compared with a conventional coin discrimination apparatus with a conventional electronic discrimination unit, thus obtaining a coin discriminating apparatus at lower cost.

The coin selection members and the coin discrimination member are all mounted on one plate, so that a large space is assured behind the other plate. Therefore, the circuit board having the electrical components for controlling the coin discrimination apparatus can be mounted in this large space. The circuit board can comprise a large circuit board, and all the electrical components can be mounted on the large circuit board. Unlike the conventional coin discrimination apparatus wherein members are mounted on the rear surface of the main plate and the circuit board has a specific shape, the working time for the circuit board can be decreased. In addition to this advantage, even if an electrical component breaks down, the single circuit board can be unplugged from a jack and be replaced with a new one, thereby greatly simplifying the maintenance procedures.

Furthermore, since one plate can be freely opened with respect to the other plate, assembly operation can be simplified, and the coin path can be easily cleaned.

BRIEF DESCRIPTION OF THE DRAWINGS

FIGS. 5 and 6 are respectively views for explaining the operation of the selection lever, in which FIG. 6 is a sectional view thereof along the line B—B of FIG. 5.

DETAILED DESCRIPTION OF THE INVENTION

Figure 1:
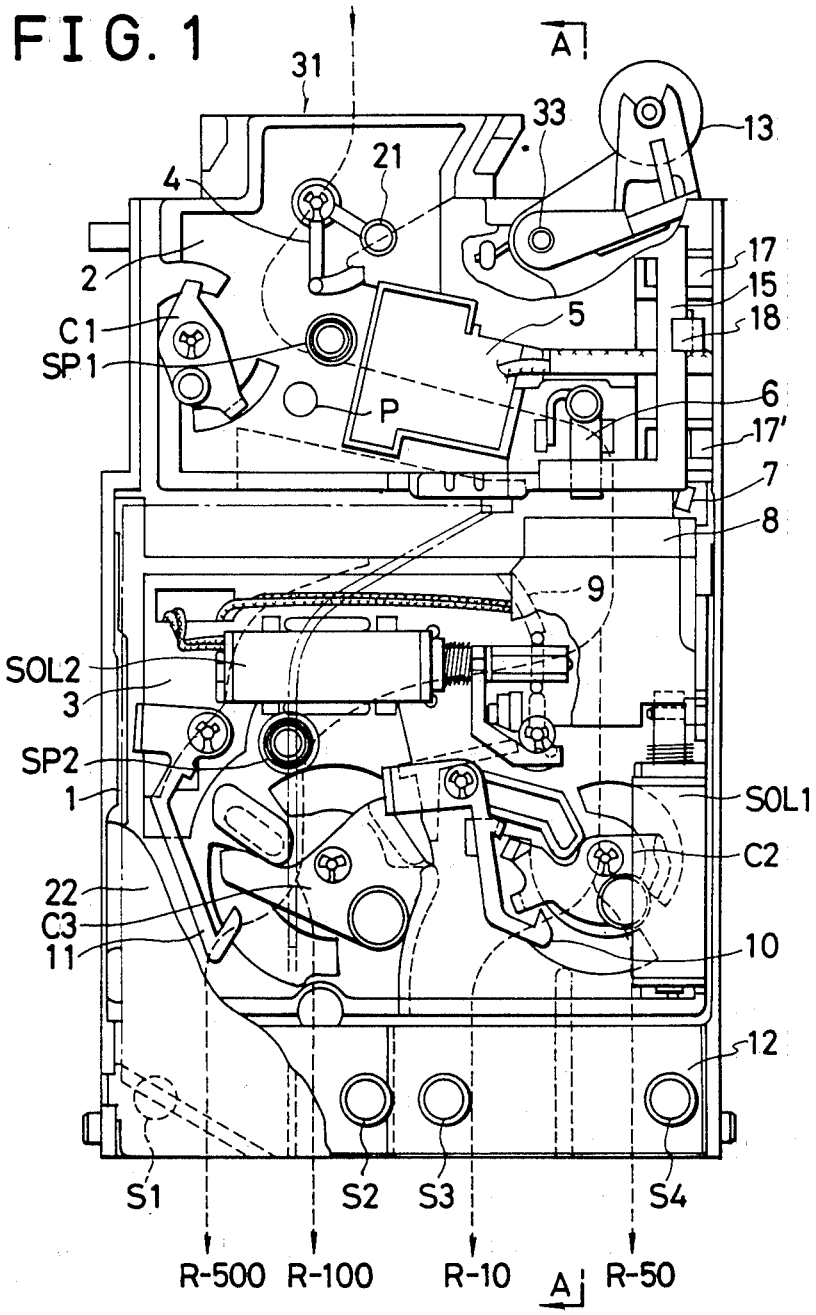
FIG. 1 is a front view of a coin discrimination apparatus according to an embodiment of the present invention.

Referring to FIG. 1, reference numeral 1 denotes a main plate; and 2 and 3 denote first and second device plates, respectively. The main plate 1 and the second and third device plates 2 and 3 define a coin path. A swing lever 4, a first cradle C1 as a discrimination member, a sensor P, one coil of an electronic discriminator 5, and a coin regulator 6 are mounted on the first device plate 2. An absolute lever 7 is mounted on the main plate 1 at a coin dispensing port formed by the first device plate 2. The absolute lever 7 receives a dropped coin and changes a dropping direction of the coin. The first device plate 2 is supported through a shaft 15 by supports 17 and 17' and a shaft holder 18 which are mounted on the main plate 1. The first device plate 2 can be pivoted about the shaft 15 toward the front direction in FIG. 1. The first device plate 2 is urged against the main plate 1 by a spring SP1 hooked between the first device plate 2 and a front cover 22 for covering the front device plate 2.

Figure 2:
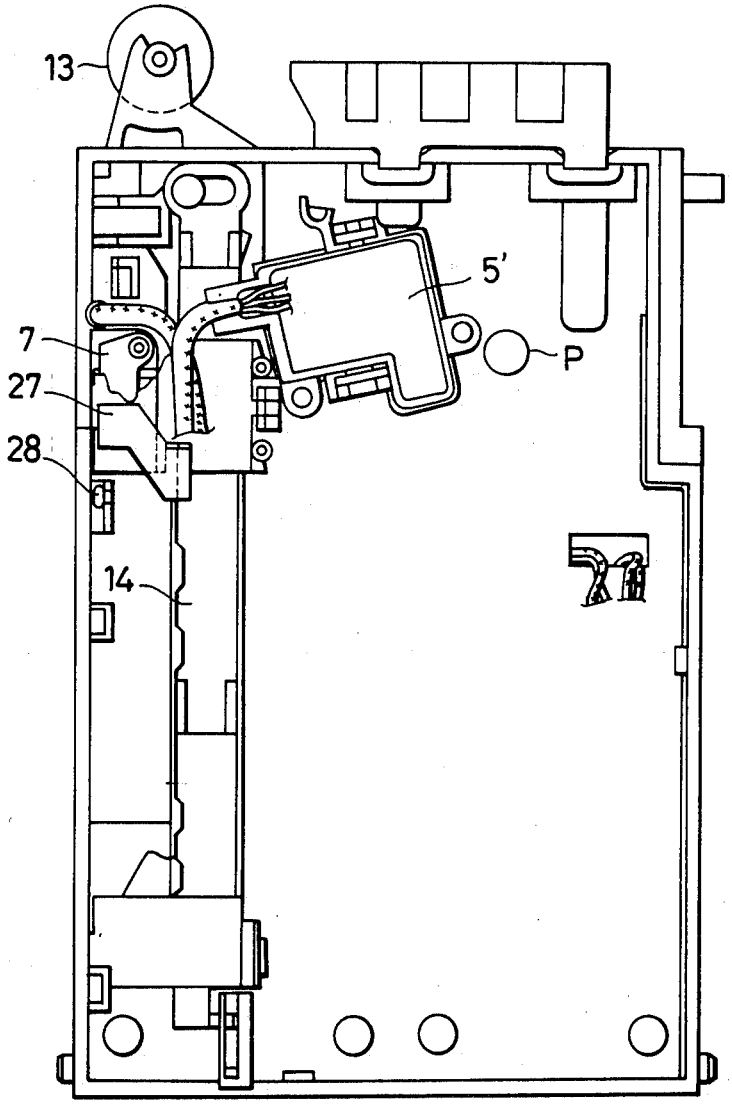
FIG. 2 is a rear view of the coin discrimination apparatus of FIG. 1 when a rear cover plate is removed.
Figure 3:
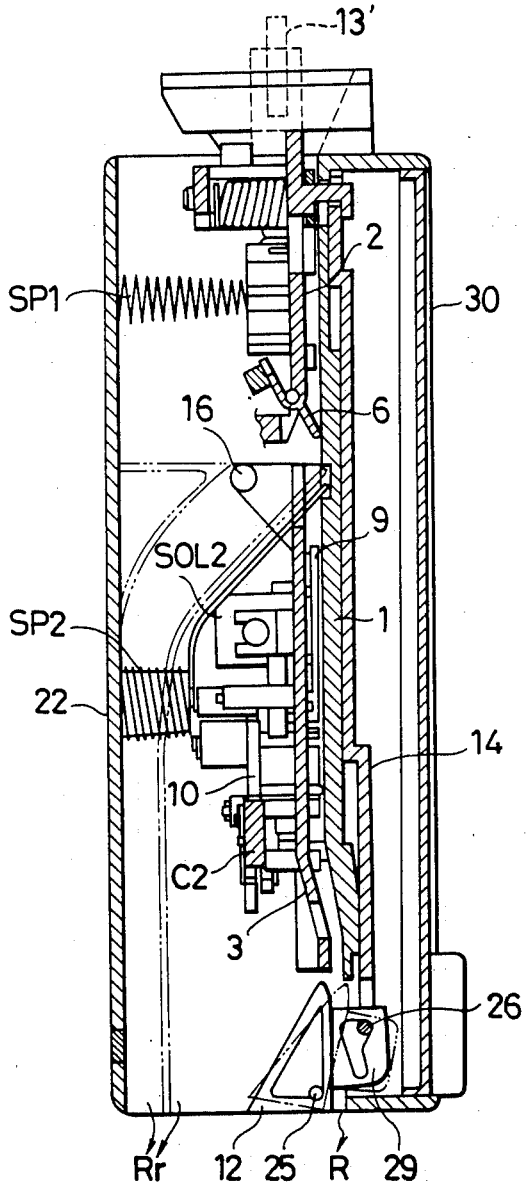
FIG. 3 is a sectional view of the coin discrimination apparatus taken along the line A—A in FIG. 1.

A first coin selection member 8, a solenoid SOL1 for actuating the first coin selection member 8, a second coin selection member 9, a solenoid SOL2 for actuating the second coin selection member 9, a second cradle C2 as a second coin discrimination member, an oversize limiter 10, a third cradle C3 as a discrimination member, and an oversize limiter 11 are mounted on the second device plate 3. The second device plate 3 is pivotally supported about a shaft (FIG. 3) and is urged against the main plate 1 by a spring SP2 hooked between the front cover 22 and the second device plate 3. Coin sensors S1 to S4 are arranged along a discriminated coin discharge path. Reference numeral 12 denotes a return guide which can be swung about a shaft 25 (FIG. 3); and 13, a gate lever which is pivoted upon pivotal movement of a coin return lever (not shown). When the gate lever 13 is pivoted, a cam (not shown) mounted on the gate lever 13 causes the first device plate 2 to pivot about the shaft 15 toward the front side (FIG. 1) against the biasing force of the spring SP1. At the same time, the cam causes a lever 14 (FIGS. 2 and 3) interlocked with the gate lever to move downward, so that a cam 27 mounted on the lever 14 urges a projection 28 formed on the second device plate 3. The second device plate 3 is pivoted about the shaft 16 against the biasing force of the spring SP2. Subsequently, a pin 26 mounted on the lever 14 urges a cam plate 29 on the return guide 12 to pivot the return guide 12 about the shaft 25 clockwise in FIG. 3, thereby closing the authentic coin path. As a result, the coins along the coin path formed between the first and second device plates 2 and 3 and the main plate 1 drop into a return path Rr. As shown in FIG. 2, only the other coil of the electronic discriminator 5 and the lever 14 are mounted on the rear surface of the main plate 1. Reference numeral 22 denotes a front cover; and 30, a rear cover plate.

Figure 4:
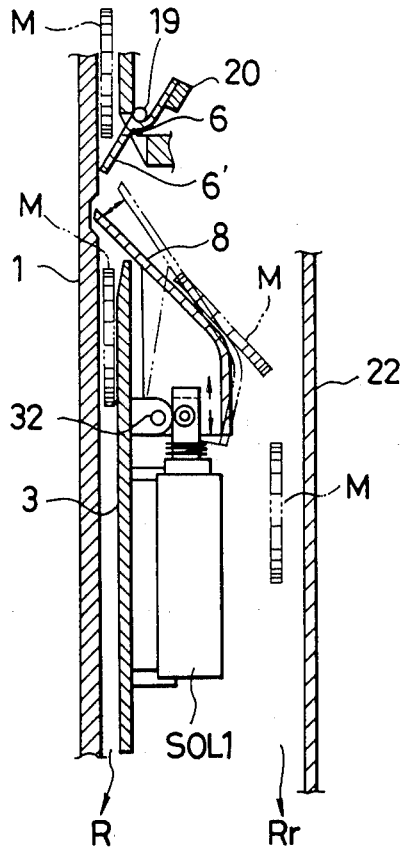
FIG. 4 is a view for explaining a selection plate in the coin discrimination apparatus.

In the construction described above, when a coin M is inserted through a coin insertion port 31 in the coin discrimination apparatus according to the present invention, the coin M abuts against the swing lever 4 to pivot the swing lever 4 counterclockwise (FIG. 1) against the force of a balancer 21. As a result, the speed of the coin M is adjusted by the swing lever 4, and the coin M is then guided to the first cradle C1. In this embodiment, the first cradle C1 causes authentic and counterfeit coins having a smaller diamqter than that of, for example, a 50 yen coin to pass therethrough. These coins are guided to the return path Rr. The conveying direction of the coins such as 10 yen, 50 yen, 100 yen and 500 yen coins having a larger diameter than that of the 50 yen coin is reversed at the first cradle C1, and the coins are guided to the electronic discriminator 5. The electronic discriminator 5 electronically discriminates the coins in accordance with the material, outer diameter and the like of the coins passing therethrough. The electronic discriminator 5 then supplies discrimination signals to the solenoids SOL1 and SOL2. The coin M abuts against the absolute lever 7 so that the moving direction of the coin M changes. The coin M passes along a coin path R formed between the main plate 1 while the coin M is urged by the coin regulator 6 against the main plate 1. As shown in FIG. 4, the coin regulator 6 is pivoted by a balancer 20 about a shaft 19 clockwise in FIG. 4 to urge the coin M against the main plate 1 and cause the coin M to drop therealong. A distal end 6' of the coin regulator 6 has a blade to cut a string connected to a coin M when the coin M is about to be pulled by the string in the reverse direction along the coin path.

The inserted coin M is then guided along the coin path R formed between the main plate 1 and the second device plate 3. In this case, the counterfeit coins are selected by the first coin selection member 8 and are guided along the return path. Rr, thereby guiding only the authentic coins along the coin path R. As shown in FIG. 4, the first solenoid SOL1 is normally deenergized, and the first coin selection member 8 is held in the position indicated by the solid line. A dropping coin C is guided by the first coin selection member 8 in the return path Rr. However, when the electronic discriminator 6 discriminates coins as authentic coins (10 yen, 50 yen, 100 yen and 500 yen coins), the first solenoid SOL1 is energized. For this reason, the first coin selection member 8 is pivoted about a shaft 32 mounted on the second device plate 3 clockwise in FIG. 4, thereby opening the coin path R. Therefore, the dropping authentic coins are guided into the coin path R. However, when the electronic discriminator 6 discriminates that the coins are counterfeit coins, the first solenoid SOL1 will not be deenergized. The counterfeit coins drop into the first coin selection member 8 and are guided in the return path Rr.

The authentic coins are thus guided into the coin path R. Ten yen and 50 yen coins drop into the second cradle C2. In this case, the 50 yen coin has a smaller diameter than that of 10 yen coin, so that the 50 yen coin drops through a space between the pawls of the second cradle C2 and is guided to a 50 yen path R-50. This 50 yen coin is then detected by the sensor S4. However, the ten yen coin can be held on the pawls of the second cradle C2. The second cradle C2 is pivoted counterclockwise in FIG. 1 while the oversize limiter 10 is urged. The 10 yen coin then drops on a 10 yen coin path R-10 and is detected by the sensor S3.

Figure 5:
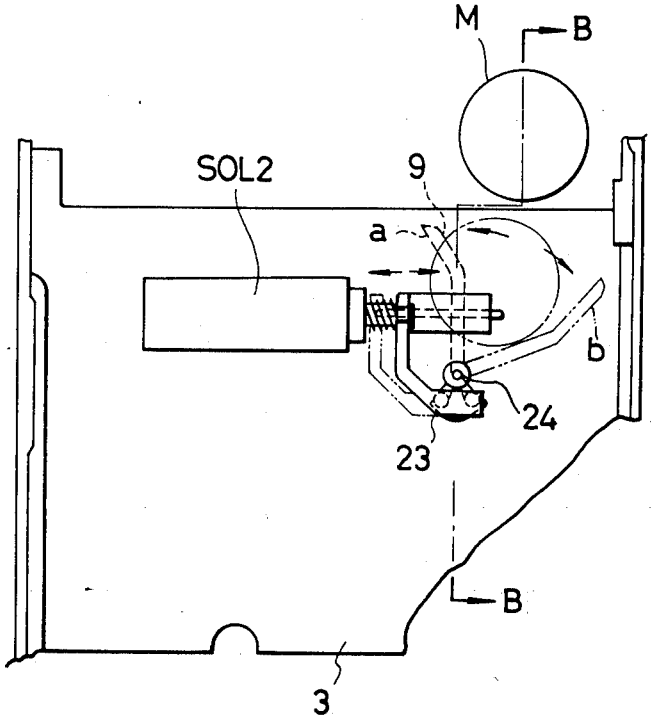
Figure 6:
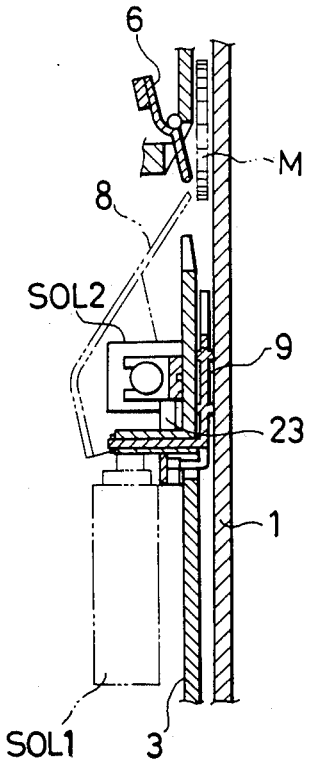

When the inserted coin M is a 100 yen or 500 yen coin, a discrimination signal is supplied from the electronic discriminator 5 to the first and second solenoids SOL1 and SOL2. As a result, the first coin selection member 8 opens the coin path R. Furthermore, since the second solenoid SOL2 is energized, a lever 23 is moved to the left, as indicated by the dotted line in FIG. 5, to pivot the second coin selection member 9 about a shaft 24 mounted on the second device plate 3 from a position a to a position b in FIG. 5. The second coin selection member 9 is inserted across the coin path R. As a result, the coin M is moved by the second coin selection member 9 to the left in FIG. 1 and is guided to the third cradle C3. The 100 yen coin having a smaller diameter than that of the 500 yen coin passes through a space between the pawls of the third cradle C3. The 100 yen coin is guided to a 100 yen coin path R-100 and is then detected by the second sensor 2. On the other hand, the 500 yen coin is supported on the pawls of the third cradle C3. The third cradle C3 is pivoted counterclockwise in FIG. 1. The 500 yen coin drops into a 500 yen coin path while the oversize limiter 11 is urged. The 500 yen coin is then detected by the sensor S1.

The attaching/detaching device operation of the first device plate 2 with respect to the main plate 1 will now be described.

Figure 7:
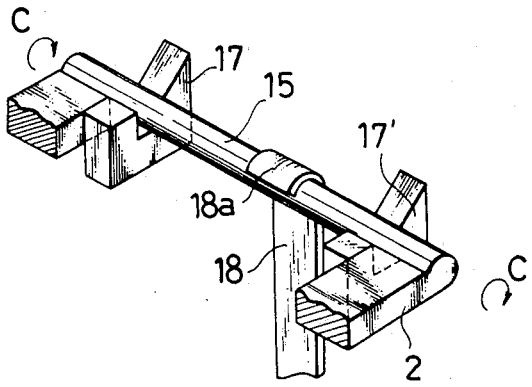
FIGS. 7 through 10 are respective views for explaining attaching/detaching operation of a device plate with respect to a main plate.
Figure 8:
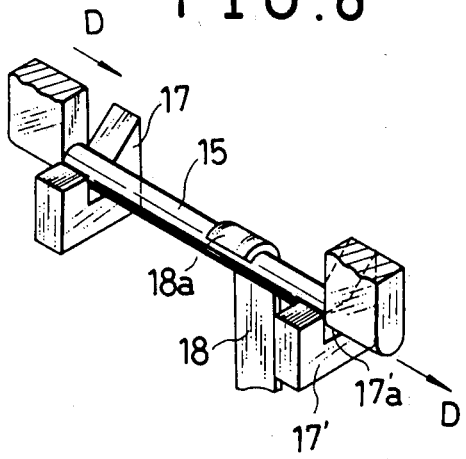
Figure 9:
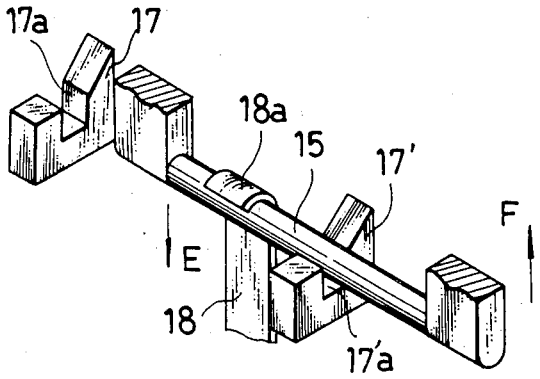
Figure 10:
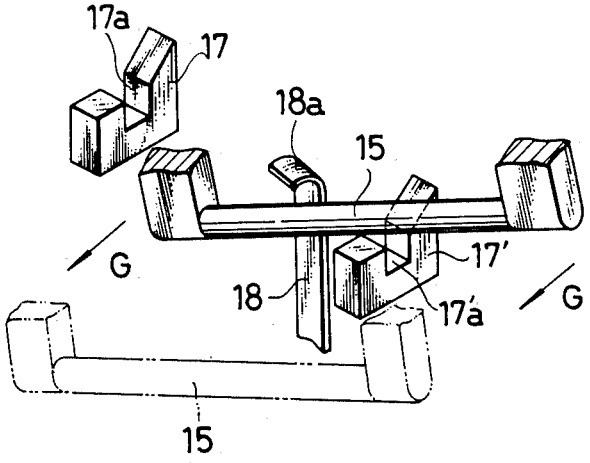

In the state wherein the shaft 15 of the first device plate 2 is locked by support grooves 17*a* and 17*a'* of the supports 17 and 17' and an engaging portion 18*a'* of the shaft holder 18 fixed on the main plate 1, in order to remove the first device plate 2 from the main plate 1, the shaft 15 is pivoted through 90 degrees along a direction indicated by arrow C, as shown in FIG. 7. Subsequently, as shown in FIG. 8, the shaft 15 is moved along a direction indicated by arrow D while the shaft 15 can be movable along its longitudinal direction. As shown in FIG. 9, one end of the shaft 15 which is disengaged from the support groove 17*a* of the support 17 and the other end thereof which is disengaged from the support groove 17*a'* of the support 17' are moved along directions indicated by arrows E and F, respectively. Finally, as shown in FIG. 10, the shaft 15 is completely disengaged from the support grooves 17*a* and 17*a'* of the supports 17 and 17' while the shaft 15 is inclined. The shaft 15 is pulled toward a direction indicated by arrow G, so that the first device plate 2 integrally formed with the shaft 15 can be removed from the main plate 1. The first device plate 2 can be attached to the main plate 1 in a manner opposite to the manner described above. In other words, the states of FIGS. 10, 9, 8 and 7 are set in the order named.

In the above embodiment, the first and second device plates are used. However, a device plate need not be divided into the first and second device plates but can be constructed from a single device plate. In this case, a hole for passing any coin therethrough may be formed in the single plate at a position where the first coin selection member 8 is selected.

It should be apparent to those skilled in the art that the above described embodiment is but one of several embodiments utilizing the principles and objects of the present invention. Numerous and varied other constructions can be made without departing from the spirit and scope of the claims.

We claim:

1. A coin discrimination apparatus for discriminating coins by denomination and for guiding coins of respective denominations to respective denomination coin paths by means of an electronic discrimination unit which is formed by two plates provided in a coin path, a coin selection member which is actuated in response to signals from said electronic discrimination unit and cradles, said coin discrimination apparatus being characterized by:

said electronic discrimination unit provided at an upstream side of said coin path;

a first coin selection member, which is actuated in response to signals from said electronic discrimination unit, provided for selecting authentic and counterfeit coins;

at least one second coin selection member provided at a downstream side of said first coin selection member, said second coin selection member being actuated in response to signals from said electronic discrimination unit for separating authentic coins into two denomination coin paths depending upon the differences in diameter of coins; and cradles provided at a downstream side of said second coin selection member, said cradles for separating by denomination said coins of each one of the two coin paths which are separated by said second coin selection member.

2. An apparatus according to claim 1, wherein said first coin selection member can cross one plate to project into the common coin path to remove the counterfeit coins from said common coin path defined by two plates.

3. An apparatus according to claim 1, wherein said coin selection member, said cradles and solenoids for driving said coin selection member are arranged on one of said two plates but not on the other of said two plates.

4. An apparatus according to claim 2, wherein there is further provided a coin regulator in said coin path, said coin regulator being arranged in a position at an upstream side of said first coin selection member so as to urge the coins against said one plate and to prevent said first coin selection member from making misselections.

5. An apparatus according to claim 4, wherein said coin regulator has a blade for cutting a string connected to a coin.

6. A coin discrimination apparatus having a coin path formed between a main plate and a device plate with a coin discrimination member for discriminating coins and a coin selection member thereon so as to discriminate coins by dropping the coins on the coin path, characterized in that a shaft is mounted at one side of said device plate, two supports respectively having support grooves for holding two ends of said shaft are arranged on said main plate, and a shaft holder having a bent engaging portion is mounted on the main plate so as not to remove two ends from said support grooves of said two supports, thereby detachably mounting said device plate on said main plate.

7. An apparatus according to claim 6, wherein said discrimination member for discriminating coin, said selection member and a drive member for driving said coin selection member are mounted on said device plate.

* * * * *